United States Patent [19]

Cahill et al.

[11] Patent Number: 4,913,329

[45] Date of Patent: Apr. 3, 1990

[54] CIGARETTE PAPER FEED

[75] Inventors: Michael J. Cahill; Kevin R. Fincham, both of Coventry, Great Britain

[73] Assignee: Molins plc, Milton Keynes, England

[21] Appl. No.: 159,899

[22] Filed: Feb. 24, 1988

[30] Foreign Application Priority Data

Feb. 27, 1987 [GB] United Kingdom ..... 8704721

[51] Int. Cl.[4] ..... B65H 20/14; A24C 5/38

[52] U.S. Cl. ..... 226/97; 131/84.1; 226/196

[58] Field of Search ..... 226/95, 97, 196, 76, 226/45, 7, 91; 242/58.2, 58.3, 78, 76, 67.2; 131/84.1, 84.3, 284

[56] References Cited

U.S. PATENT DOCUMENTS

| | | | |
|---|---|---|---|
| 4,030,652 | 6/1977 | Schulze | 226/95 X |
| 4,135,676 | 1/1979 | Hunter | 242/67.2 |
| 4,186,860 | 2/1980 | Reba | 226/91 |
| 4,466,578 | 8/1984 | Shibuya et al. | 226/97 X |
| 4,485,981 | 12/1984 | Krywiczanin et al. | 226/97 X |
| 4,531,823 | 7/1985 | Deguchi et al. | 355/3 R |
| 4,583,558 | 4/1986 | Luke | 131/284 |

FOREIGN PATENT DOCUMENTS

| | | |
|---|---|---|
| 0232689 | 8/1987 | European Pat. Off. . |
| 912485 | 12/1962 | United Kingdom . |

*Primary Examiner*—John Petrakes

*Attorney, Agent, or Firm*—Antonelli, Terry & Wands

[57] ABSTRACT

A web handling device through which a web is arranged to pass along a tortuous path extending around a number of rollers includes means for threading the web pneumatically comprising, in association with at least one of the rollers, a guide member having a guide surface which extends around part of the periphery of the roller in a spaced relationship so as to define a passage for the web, means for directing the web approximately tangentially towards the guide surface, and an air mover mounted on or adjacent to the upstream end of the guide surface, and arranged to pass a moving film of air along the guide surface while the web is being threaded through the apparatus, so as to entrain the web and convey it around the roller.

11 Claims, 3 Drawing Sheets

CIGARETTE PAPER FEED

British patent specifications Nos. 2091224, 2093808 and 2109764 describe apparatus for feeding a paper web pneumatically into and through a cigarette making machine. However, most cigarette making machines include a printer for applying a brand name or other indicia to the paper at regular intervals, and there is a problem in pneumatically threading the paper through the several rollers of a typical printer. The present invention is particularly concerned with that problem.

According to this invention, a web handling device through which the web passes along a tortuous path extending around a number of rollers (e.g. as in a cigarette paper printing device) has means for threading the web pneumatically comprising, in association with at least one of the rollers, a guide member having a guide surface which extends around part of the periphery of the roller in a spaced relationship so as to define a passage for the web, means for directing the web approximately tangentially towards the guide surface, and an air mover mounted on or adjacent to the upstream end of the guide surface and arranged to pass a moving film of air along the guide surface while the web is being threaded through the apparatus, so as to entrain the web and convey it around the roller.

Each roller preferably has an associated guide member in the form of a guide plate with an air mover. To accommodate all these parts in the confined space of a device such as a cigarette paper printer, we have devised a new form of air mover which is a further aspect of this invention.

The rollers preferably lie between end cover plates to confine the air films and to constrain the paper web to remain on the rollers. In a preferred construction, the outer cover plate is made of transparent material so that the machine operator can see the rollers and paper web. The guide members are preferably mounted or formed on the outer cover, which can be swung away from the machine to allow access to the rollers, the air movers being in turn mounted on the guide members. Passages through which air is supplied to the air movers are preferably formed in the outer cover plate.

Examples of apparatus according to this invention are shown in the accompanying drawings. In these drawings.

Figure 1:
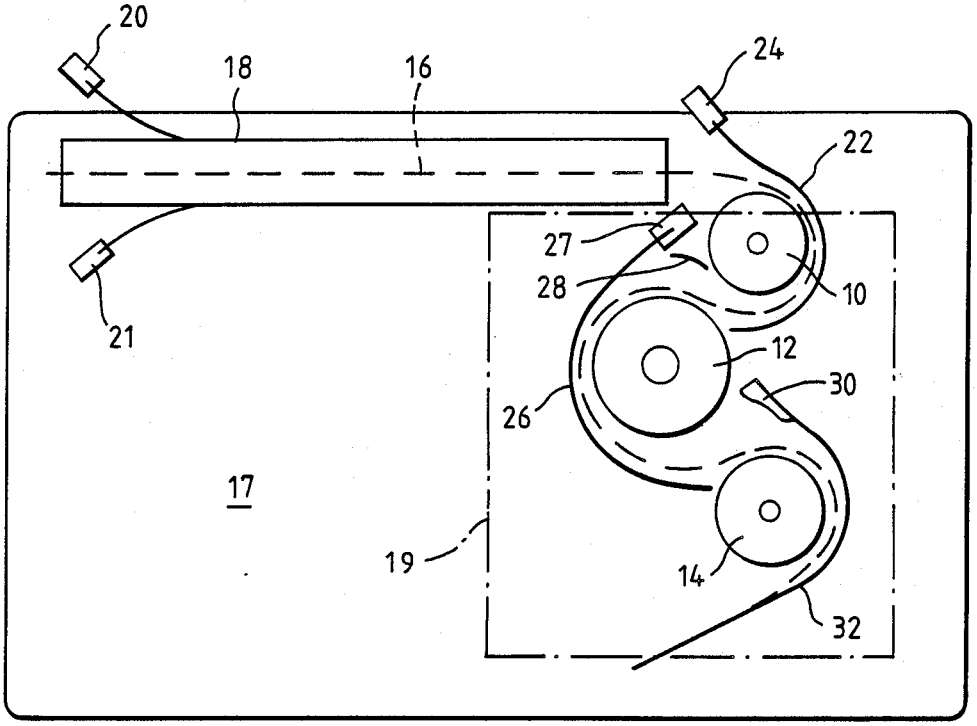
FIG. 1 shows a simple form of apparatus including three rollers.

FIG. 1 shows a simple example including three rollers 10, 12 and 14 through which a paper web 16 is required to be threaded pneumatically. The rollers are mounted on a rear plate 17 and are covered by a front plate 19 of transparent material. The paper web advances towards the rollers through a duct 18 through which it is propelled by air movers 20 and 21 in the manner generally described in GB 2109764.

The first roller 10 has an associated guide plate 22 towards which the paper web approaches from the duct 18 in a substantially tangential direction; continued movement of the web 16 in a horizontal direction as it emerges from the duct 18 causes the paper to come into contact with the plate 22. An air mover 24 mounted on the up-stream end of the plate 22 produces a moving film of air along the inner surface of the plate which entrains and conveys the leading end of the paper web along the plate 22, it being assumed that the web is positively driven forward at some point upstream of the duct 18.

On leaving the plate 22, the leading end of the paper web passes around the second roller 12, being conveyed around it initially by a guide plate 26 with n air mover 27. A deflector 28 ensures that the paper does not continue to pass around the roller 10.

In a similar manner, the paper web passes around the roller 14, being conveyed around the roller by means of an air mover 30 mounted on the upstream end of a guide plate 32. Whereas the air movers 24 and 27 are of a type described in the above-mentioned patent specifications, the air mover illustrated at 30 is of a new construction which is shown more clearly in FIGS. 3 and 4 and is described below.

Figure 2:
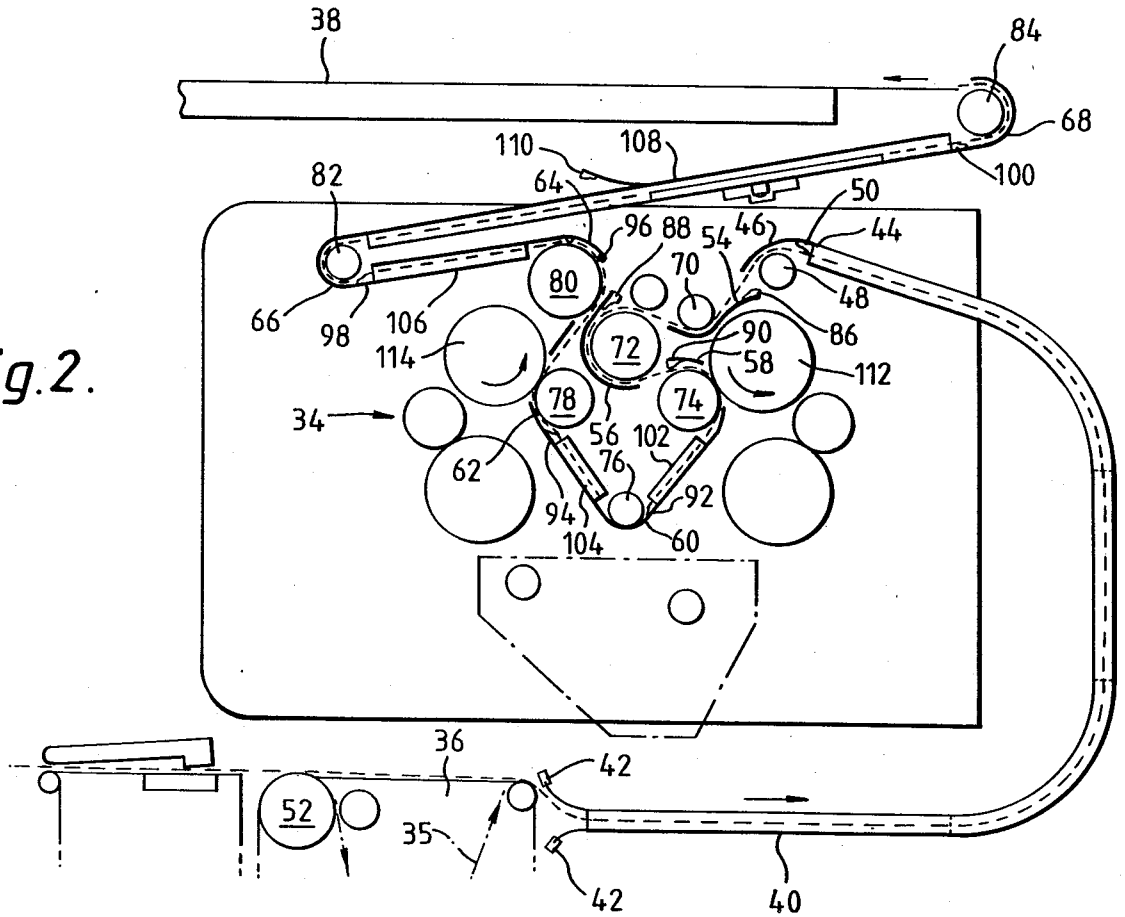
FIG. 2 shows a complete cigarette paper printing device embodying this invention.

FIG. 2 shows part of a cigarette making machine including a paper printing device 34. Cigarette paper 35 is required to be fed pneumatically from a reservoir 36 to a garniture tape 38 via the printing device. For that purpose the paper, as it emerges from the reservoir 36, enters a duct 40 through which it is propelled by air movers 42 which convey the paper all the way through the duct 40 until it emerges at the downstream end 44 of the duct in a direction approximately tangential to a guide plate 46 extending around a first roller 48. An air mover 50 mounted on the guide plate 46 conveys the leading end of the web along the guide plate 46 as the web is fed forward at a controlled rate by means of a capstan roller 52 in the reservoir.

On leaving the guide plate 46, the web is guided by successive guide plates 54, 56, 58, 60, 62, 64, 66 and 68 cooperating respectively with rollers 70 to 84 with the aid of air movers 86 to 100.

Along straight parts of the path of the web there are ducts 102 to 108 as shown in the drawing, the last one having an air mover 110 midway along it on account of its length.

During its passage through the printing device, while the cigarette making machine is in operation, indicia are printed on the cigarette paper web by a die roller 112 and/or by a die roller 114. For that purpose there is pressure contact between the or each die roller and the adjacent roller 74 or 78. While the web is being pneumatically threaded through the printing device, the pairs of rollers 74,112 and 78,114 may be separated to allow the web to pass freely between them.

Reference has been made above to rollers. However, it is possible to use, in place of a roller, a stationary guide plate or other member having a curved outer surface and being formed with radial passages through which air is blown to provide an air bearing. With that in mind, the term "roller" in this context should be construed to include such a possibility.

Figure 3:
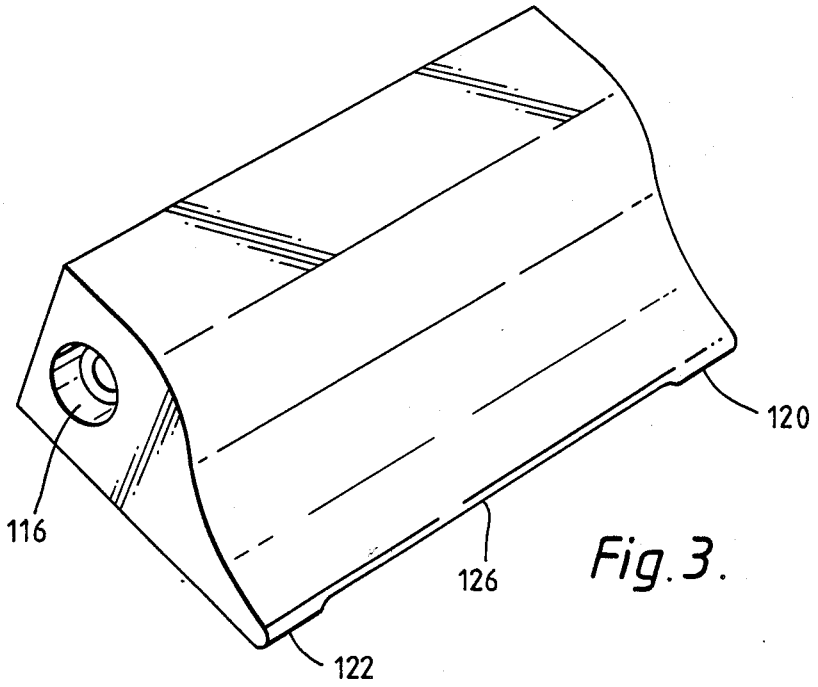
FIG. 3 is a perspective view of a new form of air mover included in FIGS. 1 and 2.
Figure 4:
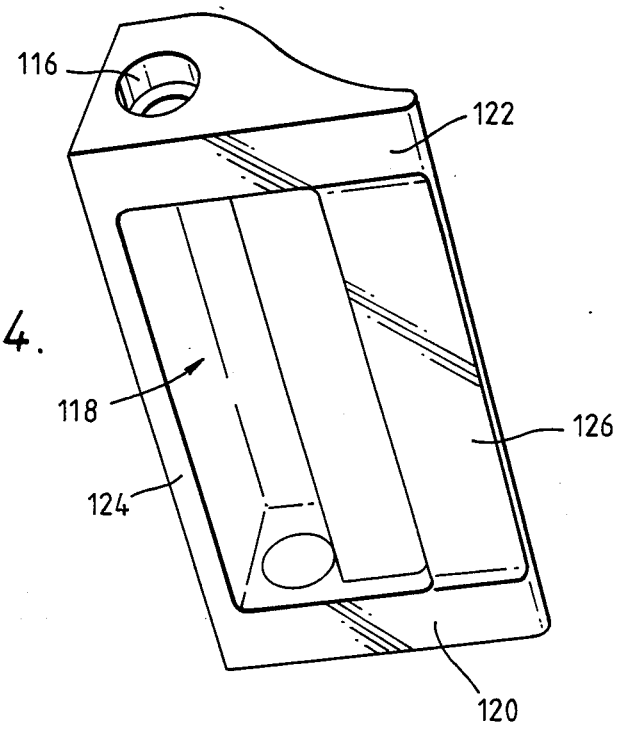
FIG. 4 is an underneath perspective view of the air mover.

FIGS. 3 and 4 show the construction of each of the air movers in FIG. 2. Compressed air is supplied through an aperture 116 into a chamber 118 formed by the body of the air mover in cooperation with the guide plate to which it is attached. The surface of the body adjacent to the plate has lands 120, 122 and 124 which are intended to be glued to the plate, and a slightly recessed part 126 defining a narrow outlet slot for the air; for example, the depth of the recess may be 0.2mm.

By way of example, we have found that a suitable air pressure for use with this air mover is approximately 13.5psi gauge (approximately 93042Pa); but this is somewhat dependent upon the precise construction of the air movers and can be determined by experiment. In general, if the air pressure is too low then the air movers tend to be ineffective in moving the paper along the corresponding guide plate, while an excessively high pressure results in the air flow becoming excessively turbulent and thus ineffective, with a risk of damaging the leading end of the paper web.

While the cigarette making machine is running, the paper web is pulled from the printing device, at a controlled speed, by the garniture tape 38 which wraps and seals the web around a tobacco stream to form a continuous cigarette rod. Once the web has been threaded pneumatically through the printer (as described above) and has been engaged by the garniture-tape, the supply of air to the air movers can be stopped; the tension in the web will then hold the web in contact with the rollers and out of contact with the guide plates. However, if one or more of the rollers (i.e. other than the printing rollers) is replaced by a stationary guide with an air bearing, the air supply to the air bearing or bearings naturally has to be maintained while the machine is running.

Figure 5:
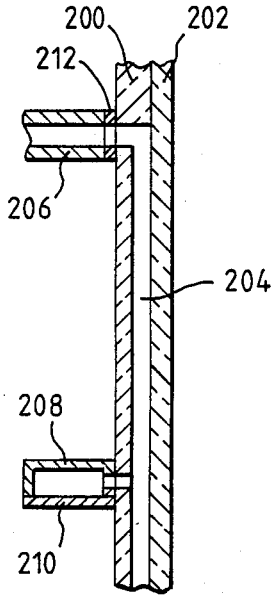
FIG. 5 is a cross-section through part of the front cover plate and one air mover.

FIG. 5 is a cross-section through part of a front cover plate covering all the rollers. The cover plate is formed by inner and outer sheets 200 and 202 of transparent material which are fastened together. The inner sheet is formed with grooves 204 forming air passages for compressed air supplied to the air movers from a fixed source conduit 206. One air mover 208 and guide plate 210 are shown by way of example, each being mounted on the cover plate. The cover plate is pivotally mounted on the machine (e.g. about a vertical axis along one side edge) so that it can be swung away to allow access to the rollers for maintenance or other purposes. The guide plates and air movers, or at least some of them, are mounted on the cover plate so that they also move clear of the rollers when the cover plate is "opened". When the cover plate is in its "closed" position as shown in FIG. 5, it engages the conduit 206 via a seal 212.

We claim:

1. A web handling device through which the web is arranged to pass along a tortuous path extending around a number of rollers and including means for threading the web pneumatically comprising, in association with at least one of the rollers, a guide member having a guide surface which extends around part of the periphery of the roller in a spaced relationship so as to define a passage for the web, means for directing the web approximately tangentially towards the guide surface, an air mover mounted on or adjacent to the upstream end of the guide surface, and arranged to pass a moving film of air along the guide surface while the web is being threaded through the apparatus, so as to entrain the web and convey it around the roller, and a front cover plate being formed with air passages through which compressed air is supplied to at least one of the air movers .

2. A device according to claim 1 including means for advancing the web into the device at a controlled rate while the web is being threaded through the device, whereby the leading end of the web is entrained and moved forward by successive moving films of air emanating from a succession of air movers associated with respective guide members.

3. A device according to claim 2 in the form of a paper web printing device for a cigarette making machine.

4. A device according to claim 1 in which at least one of the rollers, other than in a printing roller, is replaced by a guide member with a convex outer surface around which the web is arranged to pass and having compressed air passages for forming an air bearing between the web and the outer surface of the guide member.

5. A web handling device through which the web is arranged to pass along a tortuous path extending around a number of rollers and including means for threading the web pneumatically comprising, in association with at least one of the rollers, a guide member having a guide surface which extends around part of the periphery of the roller in a spaced relationship so as to define a passage for the web, means for directing the web approximately tangentially towards the guide surface, and an air mover mounted on or adjacent to the upstream end of the guide surface, and arranged to pass a moving film of air along the guide surface while the web is being threaded through the apparatus, so as to entrain the web and convey it around the roller, in which the air mover comprises a body having a surface which is secured to the guide surface, and a hollow portion forming a chamber to be supplied with compressed air, said surface which is secured to the guide surface having a cut-out portion forming a recessed surface defining with an opposed portion of the guide surface an outlet slot communicating with said hollow chamber and aligned with said guide surface for directing a film of air along the guide surface.

6. A web handling device through which the web is arranged to pass along a tortuous path extending around a number of rollers and including means for threading the web pneumatically comprising, in association with at least one of the rollers, a guide member having a guide surface which extends around part of the periphery of the roller in a spaced relationship so as to define a passage for the web, means for directing the web approximately tangentially towards the guide surface, and an air mover mounted on or adjacent to the upstream end of the guide surface, and arranged to pass a moving film of air along the guide surface while the web is being threaded through the apparatus, so as to entrain the web and convey it around the roller, in which air movers for a number of guide members are mounted on the respective guide members, which are in turn mounted on a front cover plate which is movable away from the rollers to allow access thereto.

7. A device according to claim 6 in which the air mover comprises a body having surfaces which are secured to the guide surface, a hollow portion forming a chamber to be supplied with compressed air, and a recessed surface defining with an opposed portion of the guide surface an outlet slot for a film of air directed along the guide surface.

8. An air mover for producing a film of air along a guide surface for conveying web or other sheet material along the guide surface, comprising a body having a surface which is to be secured to the guide surface, and a hollow portion forming a chamber to be supplied with compressed air, said surface which is to be secured to the guide surface having a cut-out portion forming a recessed surface defining with an opposed portion of the guide surface an outlet slot communicating with said hollow chamber and aligned with said guide surface for directing a film of air along the guide surface.

9. An air mover according to claim 8 in which the chamber is defined partly by the hollow portion of the body and partly by the guide surface to which the body is to be secured.

10. A cigarette paper web printing device including a plurality of guide rollers, at least one printing roller and means for pneumatically threading the web through the printing device comprising, in association with each of a plurality of the said rollers, a guide member having a guide surface which extends around part of the periphery of the roller in a spaced relationship so as to define a passage for the web, means for directing the web approximately tangentially towards the guide surface, and an air mover mounted on or adjacent to the upstream end of the guide surface, and arranged to pass a moving film of air along the guide surface while the web is being threaded through the apparatus, so as to entrain the web and convey it around the roller, in which at least some of the guide members and air movers are mounted on the inside face of a transparent cover plate which is movable away from the rollers to allow access thereto and is formed with air passages for the supply of air to the air movers.

11. An air mover for producing a film of air along a guide surface of a guide member for conveying web or other sheet material along the guide surface, comprising a body having a surface which is to be secured to the guide member, and a hollow portion forming a chamber to be supplied with compressed air, at least one of said surface and said guide surface having a cut-out portion forming a recessed surface defining with an opposed portion of the other of said surfaces an outlet slot communicating with said hollow chamber and arranged to direct a film of air along the guide surface.

* * * * *